US005092067A

United States Patent [19]

Prout

[11] Patent Number: 5,092,067

[45] Date of Patent: Mar. 3, 1992

[54] LEATHER IDENTIFICATION BRACELET

[75] Inventor: Julia R. Prout, Coventry, R.I.

[73] Assignee: Textron Inc., Providence, R.I.

[21] Appl. No.: 512,399

[22] Filed: Apr. 23, 1990

[51] Int. Cl.[5] ..... A44C 5/00

[52] U.S. Cl. ..... 40/633; 40/665; 224/219

[58] Field of Search ..... 40/633, 5, 6, 640, 665, 40/663, 668, 669; 63/29.1, 3; 224/164, 165, 219, 173, 178

[56] References Cited

U.S. PATENT DOCUMENTS

| | | | |
|---|---|---|---|
| 3,180,112 | 4/1965 | Lefkowitz | 63/29.1 |
| 3,585,743 | 6/1971 | Jeffers | 40/665 |
| 3,864,856 | 2/1975 | McManus | 40/665 |
| 4,226,036 | 10/1980 | Krug | 40/633 |
| 4,377,047 | 3/1983 | Adams, Jr. et al. | 40/633 |
| 4,457,460 | 7/1984 | Hirsch et al. | 224/178 |
| 4,691,460 | 9/1987 | Kohl | 40/640 |
| 4,905,879 | 3/1990 | Piccone | 224/173 |

FOREIGN PATENT DOCUMENTS

| | | | |
|---|---|---|---|
| 1288417 | 1/1969 | Fed. Rep. of Germany | 40/665 |
| 1538105 | 1/1979 | United Kingdom | 40/633 |

*Primary Examiner*—Kenneth J. Dorner
*Assistant Examiner*—Brian K. Green
*Attorney, Agent, or Firm*—Samuels, Gauthier & Stevens

[57] ABSTRACT

An ident wristband includes an elongated strap of non-metallic flexible material adapted to be buckled or otherwise detachably fastened to a wearer's wrist. A metallic ident plate is detachably secured to the outer surface of the strap by fasteners which are accessible from the strap's inner surface. A flexible cover flap of non-metallic material overlaps the fasteners to prevent them from coming into contact with the wearer's wrist.

10 Claims, 1 Drawing Sheet

LEATHER IDENTIFICATION BRACELET

BACKGROUND OF THE INVENTION

1. Field of the Invention

This invention relates generally to the field of jewelry, and is concerned in particular with the provision of an improved wristband carrying identification indicia.

Conventional identification bands (commonly referred to as "ident bracelets") comprise metal plaques connected to the wearer's wrist by metallic bracelets. The bracelets may be of the expansible or non-expansible type. Expansible bracelets can be conveniently slipped onto and off of the wearer's wrist, whereas non-expansible bracelets have clasps or other like connectors which must be coupled and uncoupled when putting on and taking off the bracelets.

However, all such bracelets share a common predominantly metallic appearance which may not be suitable for certain more casual fashion images where wardrobe components and associated accessories demand more emphasis on non-metallic, albeit less durable materials such as fabrics, leather, etc.

A general objective of the present invention is the provision of a novel ident-type wristband comprised predominantly of non-metallic flexible materials such as leather, fabrics and the like, with only a minimal incorporation of metallic components.

A more specific object of the present invention is the provision of a wristband having a metallic identification plate secured to a non-metallic flexible carrier strap in a manner permitting the plate to be conveniently detached for reuse with alternative or replacement straps.

Still another objective of the present invention is the provision of a wristband having a metallic identification plate detachably secured to a non-metallic carrier strap by screws accessible at the inner surface of the strap, and with a flexible cover flap overlapping the screws to safeguard the wearer's wrist from contact therewith.

These, and other objects and advantages of the present invention, will become more apparent as the description proceeds with the aid of the accompanying drawings, wherein:

DETAILED DESCRIPTION OF ILLUSTRATED EMBODIMENT

Figure 1:
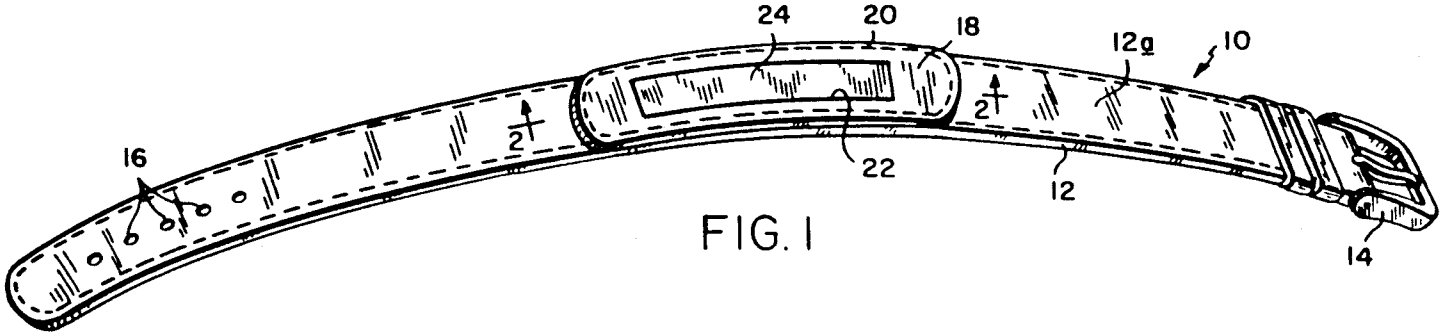
FIG. 1 is a perspective view of a wristband according to the present invention.
Figure 2:
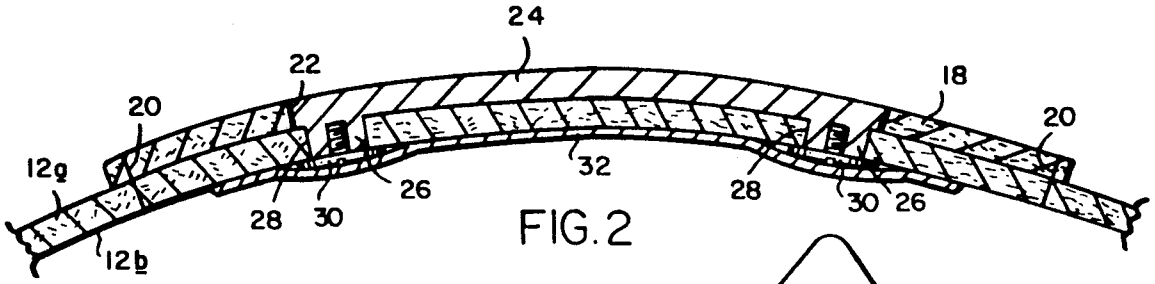
FIG. 2 is a frictional view on an enlarged scale taken along line 2—2 of FIG. 2.

Referring now to the drawings, a wristband in accordance with the present invention is generally depicted at 10. The wristband includes an elongated strap 12 of flexible material, typically leather or the like, having an outer decorative surface 12*a* and an inner surface 12*b*. Fastening means are associated with opposite ends of the strap 12 for removably fastening it to the wrist of a wearer with the decorative surface 12*a* facing outwardly and with the inner surface 12*b* facing inwardly. Typically, the fastening means will comprise a conventional buckle 14 at one end and a series of holes 16 at the opposite end.

A patch 18 of flexible material is superimposed on and fixed to the outer decorative surface 12*a* of the strap 12 at a location intermediate the ends thereof. The patch 18 may be comprised of the same material as the strap 12, or alternatively it may be comprised of a different material. Typically, the patch 18 will be affixed to the strap 12 by means of marginal stitching 20. The patch 18 is provided with an opening which cooperates with the underlying exposed strap surface 12*a* to define an open cavity 22.

A metallic plate 24 is received in the cavity 22. The top surface of the plate is adapted to display appropriate indicia which may be applied thereon by any known procedure, typically high quality engraving. The plate 24 has integral tubular studs 26 protruding from the underside thereof. The studs extend through holes 28 in the strap 12. The studs 26 are internally threaded to receive flat-headed screws 30 which serve to detachably secure the plate 24 within the cavity 22. The screws 30 are readily accessible at the underside 12*b* of the strap.

Figure 3:
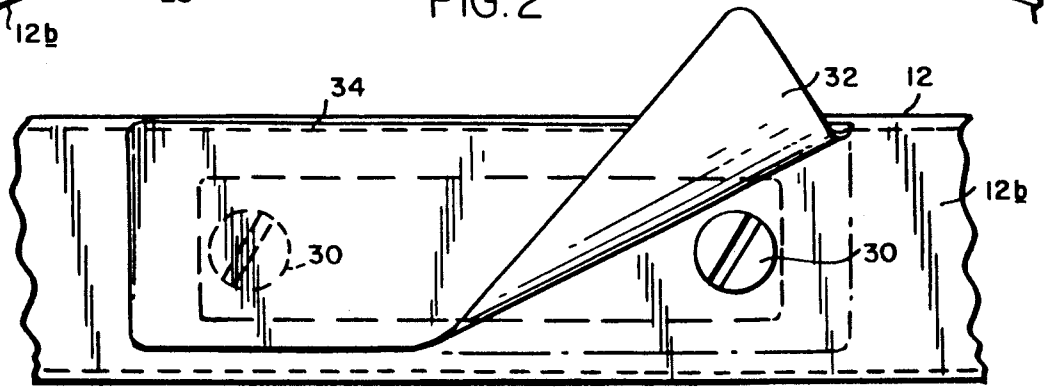
FIG. 3 an enlarged partial bottom view with the flexible cover flap partially peeled back to reveal one of the underlying screws used to hold the metal ident plate in place.

A flexible somewhat rectangular non-metallic cover flap 32 overlaps the screws 30 and is secured to the underside of the strap along one edge by stitching as at 34. As shown in FIG. 3, the cover flap 32 may be peeled back in order to gain access to the screws 30. When in place, however, the cover flap overlaps the screws and thus safeguards the wearer's wrist from coming into contact with the screws.

In light of the foregoing, it will be seen that the present invention provides an ident bracelet which is comprised predominantly of non-metallic materials, preferably leather or the like. The metallic plate 24 is detachably secured to the strap and can thus be easily removed for use with alternative or replacement straps. The means employed to fasten the plate to the strap are totally hidden from view and are protected from contact with the wearer's wrist by the flexible cover flap 32.

I claim:

1. A wristband comprising:

an elongated strap of nonmetallic flexible material;

fastening means associated with opposite ends of said strap for detachably fastening said strap to a wearer's wrist, with an outer surface of the strap facing outwardly and being exposed to view, and with an inner surface of the strap facing inwardly and being hidden from view;

means on the outer surface of said strap at a location intermediate its ends for defining an open cavity, the bottom of said cavity being closed by the outer surface of said strap;

a metallic plate received inn said cavity, said plate having an exposed surface arranged to display indicia; and securing means accessible solely at the inner surface of said strap for detachably securing said plate within said cavity.

2. The wristband of claim 1 further comprising nonmetallic cover means attached to the inner surface of said strap, said cover means being arranged to overlap said securing means and being pliable to accommodate access to said securing means.

3. The wristband of claim 2 wherein said cover means is comprised of a rectangular flap secured along one edge to the inner surface of said strap.

4. The wristband of claim 1 wherein the means for defining said open cavity is comprised of a patch of flexible material secured to the outer surface of said strap, said patch having an aperture therein cooperating with the outer surface of said strap to define said cavity.

5. The wristband of claim 4 wherein the flexible materials of said strap and said patch are the same.

6. The wristband of band 4 wherein said strap and said patch are formed from dissimilar materials.

7. The wristband of claim 1 wherein said strap is provided with through openings communicating with said cavity, and wherein said securing means extends through said openings.

8. The wristband of claim 7 wherein said securing means comprises tubular studs formed integrally with and protruding from an underside of said plate into said through openings, and screws threaded into said studs from the inner surface of said strap.

9. The wristband of claim 8 further comprising a flexible cover overlapping said screws.

10. A wristband comprising:

an elongated strap of flexible material having an outer decorative surface and an inner surface;

fastening means associated with opposite ends of said strap for detachably fastening said strap to the wrist of a wearer with said decorative surface facing outwardly and with said inner surface facing inwardly;

a patch of flexible material superimposed on and fixed relative to the outer decorative surface of said strap at a location intermediate the ends thereof, said patch having an opening therein cooperating with that portion of said outer decorative surface in registry therewith to define an open cavity, the bottom of said cavity being closed off by the outer decorative surface of said strap;

a plate received in said cavity, said plate having an exposed surface arranged to display indicia;

openings extending through said strap in communication with said cavity;

internally threaded studs protruding from said plate into the openings extending through said strap;

screws threaded into said studs from the inner surface of said strap to detachably secure said plate within said cavity; and cover means on the inner surface of said strap at a location overlapping said screws, said cover means being flexible to accommodate access to said screws.

* * * * *